US010753572B1

(12) United States Patent
Sayers et al.

(10) Patent No.: US 10,753,572 B1
(45) Date of Patent: Aug. 25, 2020

(54) DUAL DISTRIBUTION LENS FOR A LUMINAIRE

(71) Applicant: SIGNIFY HOLDING B.V., Eindhoven (NL)

(72) Inventors: Wilston Nigel Christopher Sayers, Atlanta, GA (US); Praveera Manjappa, Peachtree City, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/528,313

(22) Filed: Jul. 31, 2019

(51) Int. Cl.

| | |
|---|---|
| ***F21V 21/00*** | (2006.01) |
| ***F21V 5/04*** | (2006.01) |
| ***F21V 17/06*** | (2006.01) |
| ***F21V 13/04*** | (2006.01) |
| *F21Y 115/10* | (2016.01) |

(52) U.S. Cl.
CPC ..... *F21V 5/04* (2013.01); *F21V 13/04* (2013.01); *F21V 17/06* (2013.01); *F21Y 2115/10* (2016.08)

(58) Field of Classification Search
CPC ..... F21V 5/04; F21V 13/04; F21V 17/06
USPC ..... 362/277, 330, 333, 311.02
See application file for complete search history.

(56) References Cited

U.S. PATENT DOCUMENTS

| | | | | |
|---|---|---|---|---|
| 6,079,844 | A * | 6/2000 | Whitehead | F21S 8/00 362/23.18 |
| 6,379,012 | B1 | 4/2002 | Enochs | |
| 7,195,359 | B1 | 3/2007 | Conti | |
| 7,993,025 | B2 * | 8/2011 | Chiu | F21K 9/233 362/249.02 |
| 8,947,349 | B1 | 2/2015 | Hart | |
| 9,091,426 | B2 * | 7/2015 | Bell | F21V 13/04 |
| 9,379,012 | B2 | 6/2016 | Alptekin | |
| 2002/0149943 | A1 * | 10/2002 | Obata | G09F 13/04 362/339 |
| 2005/0270766 | A1 * | 12/2005 | Kung | G02F 1/133526 362/97.3 |
| 2010/0289664 | A1 | 11/2010 | Mizushima | |
| 2014/0043516 | A1 | 2/2014 | Baker | |
| 2016/0298820 | A1 | 10/2016 | Deely et al. | |

OTHER PUBLICATIONS

HALO Commercial. PR8 8" LED Fixture. Eaton Brochure. pp. 1-4.

* cited by examiner

*Primary Examiner* — Laura K Tso

(57) ABSTRACT

A luminaire includes a housing, a light source, and a lens. The lens has a first side and a second side and at least one of the first side and the second side has optical features. The lens can be positioned in the luminaire in a first position with the first side facing upward and in a second position with the second side facing upward. The two options for positioning the lens within the luminaire provide two different distributions for light exiting the luminaire.

20 Claims, 5 Drawing Sheets

DUAL DISTRIBUTION LENS FOR A LUMINAIRE

TECHNICAL FIELD

Embodiments of the technology relate generally to luminaires and more particularly to a dual distribution lens for a luminaire.

BACKGROUND

Luminaires (or light fixtures) often include multiple components, such as a housing, a light source, a reflector, a lens, and a trim. Among the various components of luminaires, sellers can offer customers options for the various components. For example, a seller of luminaires can offer customers different types of trims that provide different appearances. Sellers of luminaires also can offer different types of lenses that provide different distributions of light. For instance, the seller can offer customers a first type of lens that provides a wide distribution of light from the luminaire. However, if a customer wants or a specific environment calls for a more narrow distribution of light, the seller can offer a second type of lens that modifies the light exiting the luminaire to achieve a more narrow distribution of light. In some cases, the seller may offer a variety of lenses with each luminaire to provide a variety of different distributions.

However, offering a variety of different lenses for sale with a luminaire adds expense because the manufacturer must create tooling for making each variety of lens. Additionally, offering a variety of lenses for sale with a luminaire adds supply chain costs and challenges because the seller must keep each variation of the lens in stock. Accordingly, it would be beneficial to provide a solution that allows customers to choose different light distributions while also minimizing the number of different lenses that are required to be manufactured and held in stock for sale to customers.

SUMMARY

The present disclosure relates generally to luminaires, and more particularly to a lens that provides two different distributions of light for the luminaire. In one example embodiment, a luminaire comprises a housing, a light emitting diode light source disposed within the housing, a reflector disposed within the housing, and a lens disposed within the housing. The reflector is oriented within the housing to reflect a portion of light emitted from the light emitting diode light source. The lens comprises a first side and a second side, wherein at least one of the first side and the second side comprises a pattern of optical features. The lens further comprises an attachment feature configured to attach the lens to the luminaire either in a first position with the first side facing the light emitting diode light source or in a second position with the second side facing the light emitting diode light source.

In another example embodiment, a luminaire comprises a housing, a light emitting diode light source disposed within the housing, and a lens disposed within the housing. The lens comprises a first side and a second side, wherein at least one of the first side and the second side comprises a pattern of optical features. The lens further comprises an attachment feature configured to attach the lens to the luminaire either in a first position with the first side facing the light emitting diode light source or in a second position with the second side facing the light emitting diode light source.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

DETAILED DESCRIPTION OF EXAMPLE EMBODIMENTS

Figure 1:
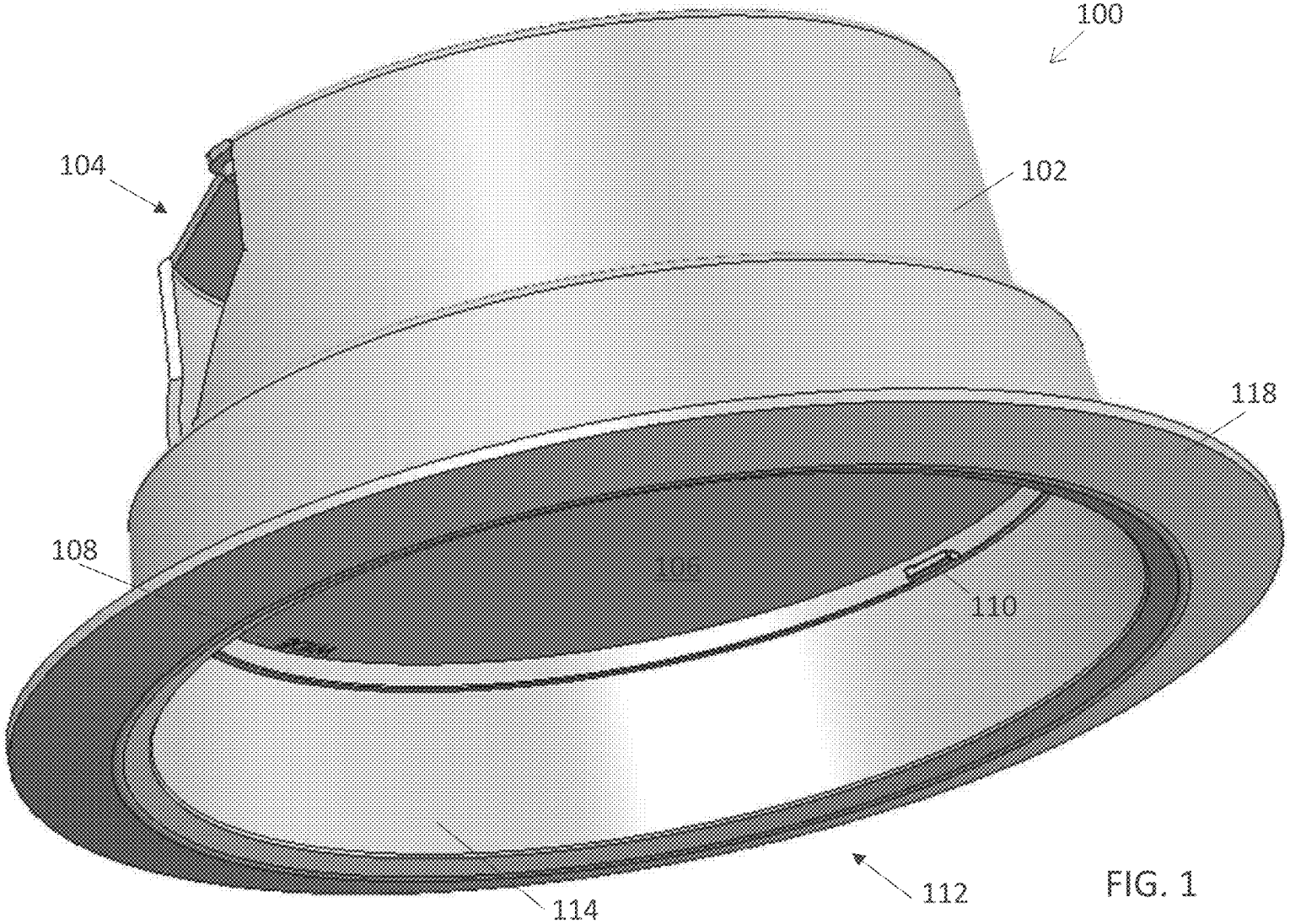
FIG. 1 illustrates a luminaire that includes a dual distribution lens according to an example embodiment of the present disclosure.

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

The example embodiments described herein relate to a luminaire having a housing and a lens disposed within the housing. The lens comprises two different broad surfaces. When the lens is oriented in the luminaire housing with the first broad surface facing the light source, the lens emits light having a first distribution. However, when the lens is removed, flipped over, and inserted back into the luminaire housing so that the lens is oriented with the opposite second broad surface facing the light source of the luminaire, the lens emits light having a second distribution that is different from the first distribution. The example embodiments illustrated in the attached figures pertain to a recessed luminaire. However, it should be understood that the example embodiments described herein are representative and the disclosure can be applied to other types of light fixtures, including but not limited to surface mounted light fixtures, pendant light fixtures, troffer light fixtures, highbay light fixtures, outdoor light fixtures, and flood light fixtures.

In certain example embodiments, the example light fixtures are subject to meeting certain standards and/or requirements. For example, the National Electric Code (NEC), the National Electrical Manufacturers Association (NEMA), the International Electrotechnical Commission (IEC), the Federal Communication Commission (FCC), and the Institute of Electrical and Electronics Engineers (IEEE) set standards as to electrical enclosures (e.g., light fixtures), wiring, and electrical connections. As another example, Underwriters Laboratories (UL) sets various standards for light fixtures, including standards for heat dissipation. Use of example embodiments described herein meet (and/or allow a corresponding device to meet) such standards when required.

Any light fixture components (e.g., housings, reflectors, lenses, trim assemblies), described herein can be made from a single piece (e.g., as from a mold, injection mold, die cast, 3-D printing process, extrusion process, stamping process, or other prototype methods). In addition, or in the alternative, a luminaire (or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

An attachment feature (including a complementary attachment feature) as described herein can allow one or more components and/or portions of an example lens, reflector, housing or other component of a light fixture to become coupled, directly or indirectly, to another portion or other component of a light fixture. An attachment feature can include, but is not limited to, a flange, a snap, Velcro, a clamp, a portion of a hinge, an aperture, a recessed area, a protrusion, a slot, a spring clip, a tab, a detent, and mating threads. One portion of an example lens can be coupled to a light fixture by the direct use of one or more attachment features.

In addition, or in the alternative, a portion of a light fixture can be coupled using one or more independent devices that interact with one or more attachment features disposed on a component of the lens, light fixture, or other component of a light fixture. Examples of such devices can include, but are not limited to, a pin, a hinge, a fastening device (e.g., a bolt, a screw, a rivet), epoxy, glue, adhesive, tape, and a spring. One attachment feature described herein can be the same as, or different than, one or more other attachment features described herein. A complementary attachment feature (also sometimes called a corresponding attachment feature) as described herein can be a coupling feature that mechanically couples, directly or indirectly, with another coupling feature.

Terms such as "first", "second", "top", "bottom", "side", "distal", "proximal", and "within" are used merely to distinguish one component (or part of a component or state of a component) from another. Such terms are not meant to denote a preference or a particular orientation, and are not meant to limit the embodiments described herein. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 2:
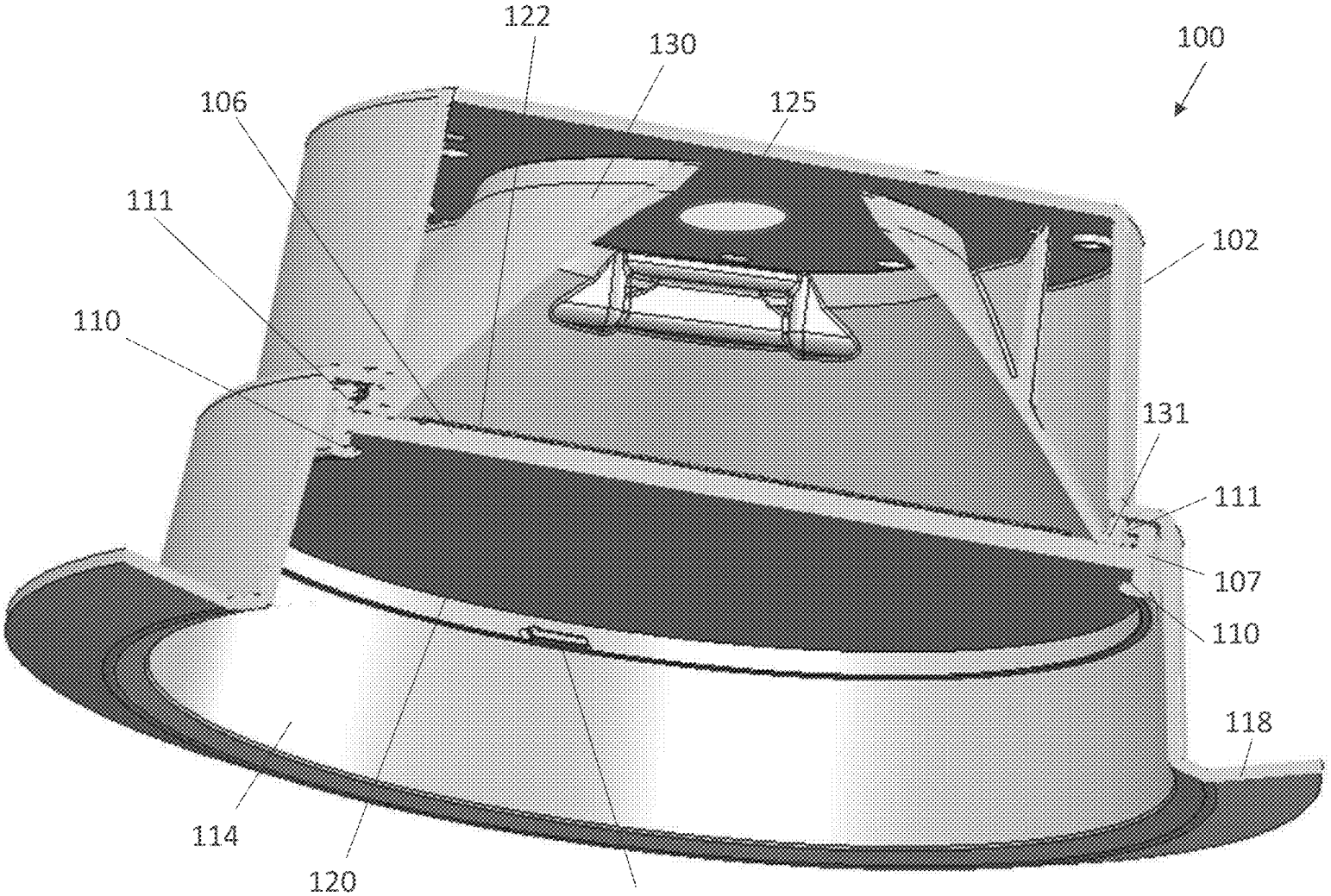
FIG. 2 illustrates a cross-sectional view of the luminaire of FIG. 1 according to an example embodiment of the present disclosure.
Figure 3:
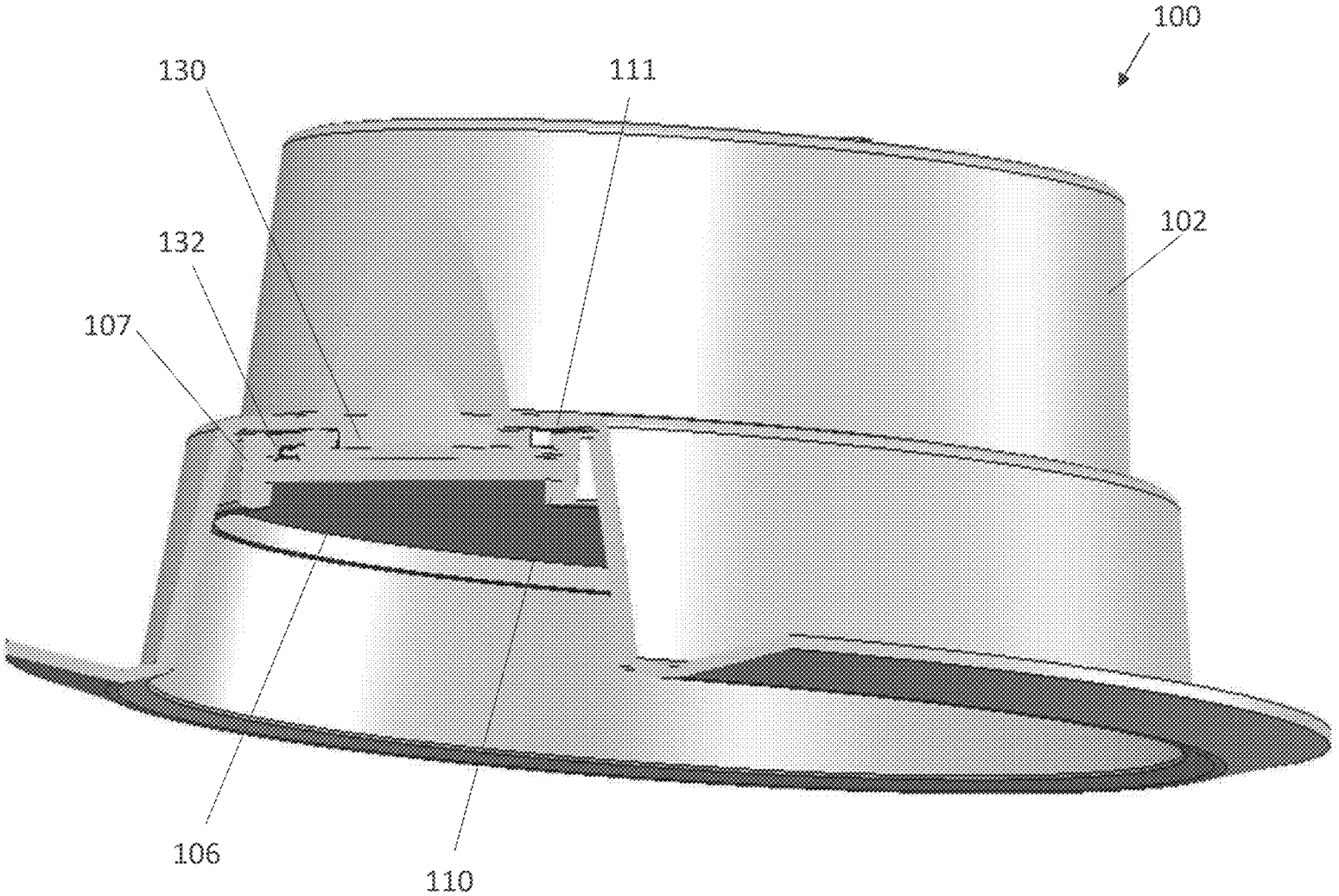
FIG. 3 illustrates another cross-sectional view of the luminaire of FIG. 1 according to an example embodiment of the present disclosure.

Referring now to FIGS. 1-3, an example luminaire 100 comprising a dual distribution lens is illustrated. FIG. 1 shows a perspective view of luminaire 100 with a view up into the light emitting aperture 112. FIG. 2 shows a cross-sectional view of luminaire 100 with the cross section taken along a vertical plane passing through the luminaire 100. FIG. 3 shows another cross-sectional view of luminaire 100 with the cross section taken along another vertical plane passing through the luminaire 100. The example luminaire 100 is a recessed luminaire for installation in a ceiling. Although not shown in FIGS. 1-3, the recessed luminaire 100 can be mounted using any of a variety of known methods including but not limited to fasteners, torsion springs, friction clips, and mounting brackets.

The primary components of the example luminaire 100 comprise a housing 102, a light source 125, a reflector 130, and a lens 106. The housing 102 comprises an interior surface 114 which can be reflective so as to reflect light incident on the interior surface 114. The lower edge of the interior surface 114 defines the light emitting aperture 112. The housing 102 further comprises a housing flange 118 extending from the lower edge of the interior surface 114 of the housing 102. The housing flange 118 can cover any gaps which may exist between the luminaire 100 and the surface (e.g., a ceiling) in which the luminaire 100 is mounted. The housing 102 of example luminaire 100 also comprises an optional service aperture 104. The service aperture 104 provides access to the interior of the housing 102 and can be used, for example, to make wiring connections when installing the luminaire 100.

The light source illustrated in FIG. 2 is a chip on board LED light source 125, which is mounted to the interior upper surface of housing 102. It should be understood that in alternate embodiments other types of light sources can be implemented including but not limited to a single LED, an array of LEDs, and one or more organic LEDs. Additionally, in alternate embodiments, the light source can be located in other positions within the luminaire.

In the example of FIGS. 1-3, the reflector 130 is mounted within the housing 102 near the interior upper surface and near the light source 125. The reflector 130 is generally conical in shape and comprises an entrance opening proximal to the light source 125 and an exit opening distal from the light source 125. The reflector 130 receives some of the light emitted by the light source 125 and reflects the incident light down toward the light emitting aperture 112. Although the housing 102 and the reflector 130 are shown as distinct components in the example of FIGS. 1-3, it should be understood that the dual distribution lens can be implemented in a variety of luminaires which may have different housings and may or may not include a reflector. As one example, in an alternate embodiment, the separate reflector can be omitted and the interior of the housing can comprise a reflective surface. In yet other alternate embodiments, a reflective surface within the luminaire may be unnecessary.

In the example luminaire 100 illustrated in FIGS. 1-3, the reflector 130 comprises a reflector flange 131 which extends outward from the bottom edge of the reflector 130. The reflector flange 131 retains the dual distribution lens 106 within the housing 102. As shown in FIG. 2, the dual distribution lens 106 comprises a first broad surface (or first side) 122, a second broad surface (or second side) 120, and a rim 107 about the perimeter of the lens 106. The rim 107 of the lens 106 comprises one or more attachment features for securing the lens 106 within the housing 102. In the example of FIGS. 1-3, the attachment features are tabs 110 and 111 disposed along the interior surface of the rim 107.

As shown in FIG. 3, the reflector flange 131 comprises one or more gaps 132 through which tabs 110 or tabs 111 can fit. In a first orientation, the tabs 111 of the rim 107 are inserted into the gaps 132 of the reflector flange 131 and the lens 106 is rotated so that the tabs 111 rest on the upper side of the reflector flange 131. Once the lens 106 is positioned with the tabs 111 passing through the gaps 132 and the lens 106 is rotated, the lens 106 is secured by the reflector flange 131 within the luminaire in the first orientation.

The first broad surface 122 of the lens comprises a pattern of optical features which makes the first broad surface 122 different from the second broad surface 120. As such, in the first orientation, the lens 106 provides a first distribution of light created by the light from the light source 125 encountering the pattern of optical features on the first broad surface 122 before the light passes through the lens 106. The lens 106 can comprise an indicator 108, such as the word "WIDE", on one or both of the first broad surface 122 and the second broad surface 120 indicating the type of light distribution associated with the orientation of the lens 106.

The light distribution emitted by the luminaire 100 can be changed by reorienting or flipping over the same lens 106 without the need for another lens. In other words, instead of providing two lenses with different light distributions, two different light distributions can be achieved with the single lens having different surfaces on the opposite broad surfaces of the lens. Continuing with the lens 106 in the first orientation described in the previous paragraph, the lens 106 can be rotated so that the tabs 111 pass back through the gaps 132 in the reflector flange 131 and so that the lens 106 can be removed from the housing 102. Once removed, the lens 106 can be flipped over so that the second broad surface 120 faces upward toward the light source 125. The lens 106 can then be inserted back into the housing 102 so that the tabs 110 on the second side of the lens 106 are inserted into the gaps 132 in the reflector flange 131. Once the tabs 110 are inserted into the gaps 132, the lens 106 is rotated so that the tabs 110 rest on top of the reflector flange 131 and the lens 106 is retained in place in a second orientation within the luminaire 100. The second broad surface 120 is different than the first broad surface 122 so that a different light distribution is emitted by the luminaire 100 when the lens 106 is in the second orientation.

It should be understood that the tabs 110 and 111 and the reflector flange 131 are merely one example of attachment features for securing the lens 106 within the luminaire 100. As one example, in alternate embodiments, instead of a plurality of tabs 111 proximal to the first side 122 and a plurality of tabs 110 proximal to the second side 120 of the lens 106, there may be only a single attachment feature on each side of the lens. In another alternate embodiment, the tabs can be located on the outer surface of the rim 107 and the tabs can attach to a ledge on the interior surface of the housing 102. In yet another example, the bottom of the reflector can be wider than the lens with a reflector flange extending inward and the tabs can be located on the outer surface of the rim 107 such that they rest on the inward extending reflector flange. In yet other examples, the tabs can be replaced by threads, detents, or a variety of other types of attachment features that allow the lens to be easily attached to and detached from the luminaire so that the lens can be easily flipped over from the first orientation to the second orientation. It should also be understood that in alternate embodiments and alternate types of light fixtures, the lens can be located at different positions with respect to the luminaire. For example, while the example of FIGS. 1-3 shows the lens 106 recessed in the housing 102, in other embodiments, the lens can be located adjacent the housing flange 118 at the light emitting aperture 112.

Figure 4:
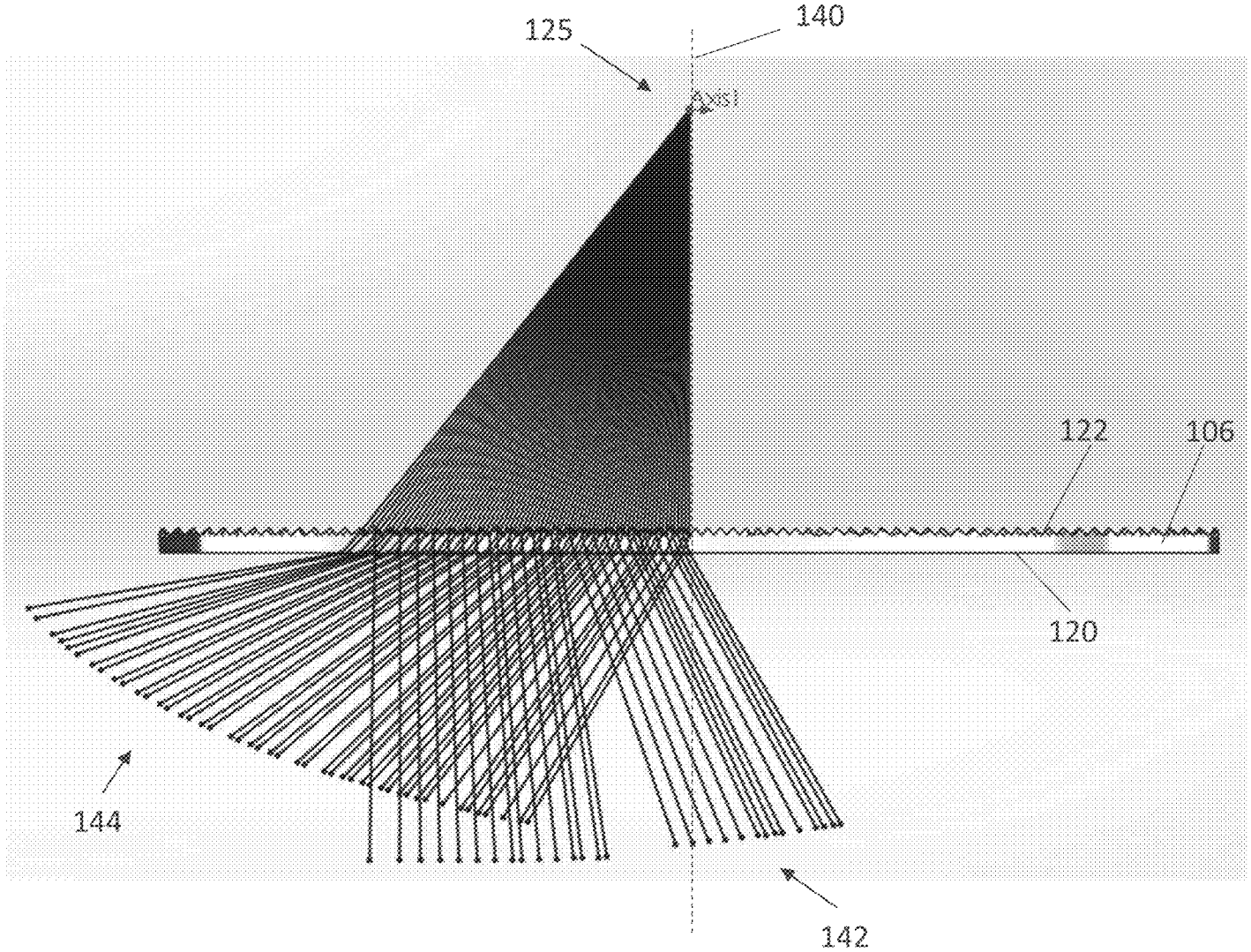
FIG. 4 is a ray trace diagram illustrating a wide distribution of light according to an example embodiment of the present disclosure.
Figure 5:
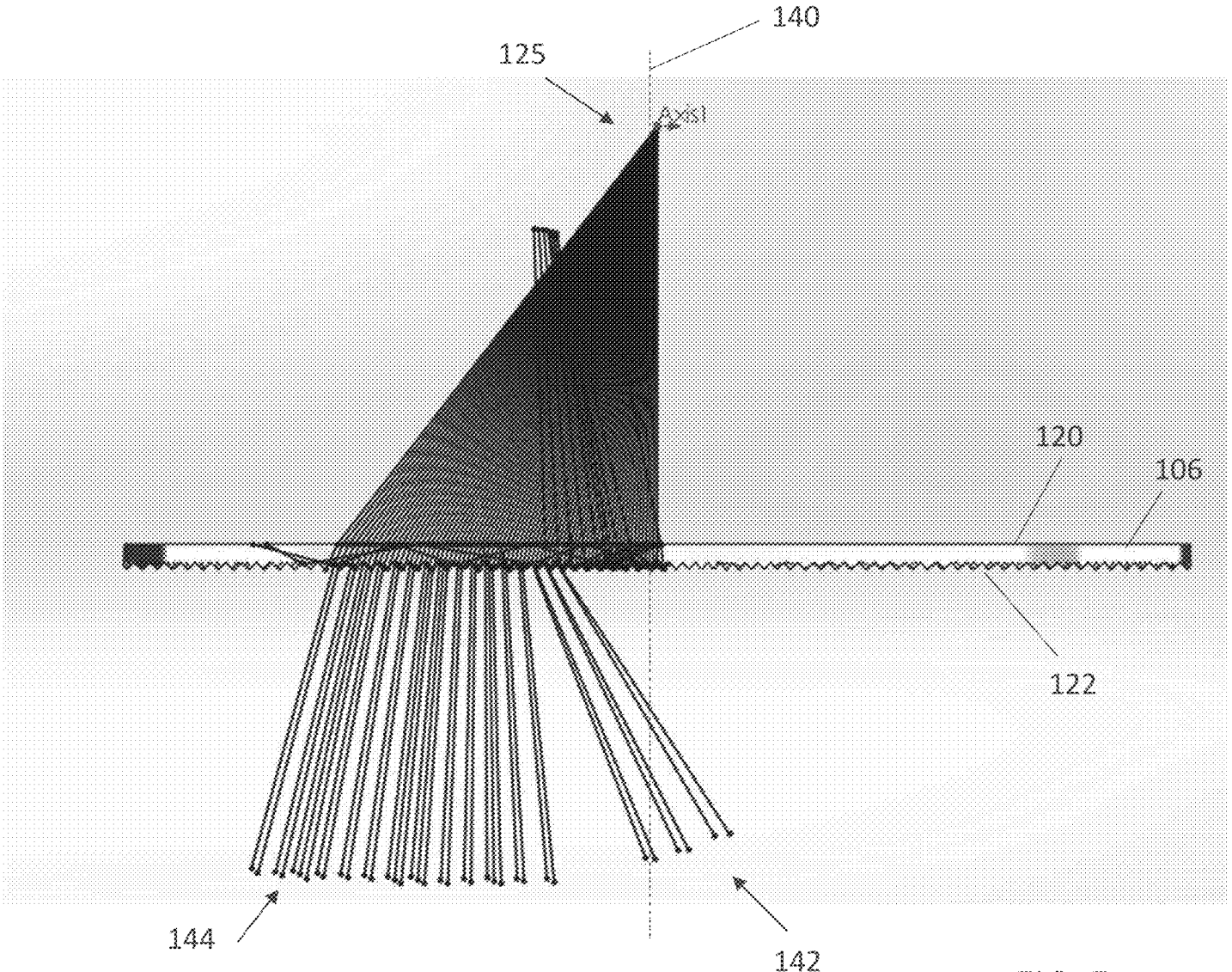
FIG. 5 is a ray trace diagram illustrating a narrow distribution of light according to an example embodiment of the present disclosure The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals used in different drawings designate like or corresponding but not necessarily identical elements.

Referring now to FIGS. 4 and 5, two ray trace diagrams are provided illustrating the different light distributions that can be achieved by reorienting the lens 106 from the first orientation to the second orientation. For purposes of clarity, the ray trace diagrams shown in FIGS. 4 and 5 have been simplified from the example luminaire of FIGS. 1-3 in that the housing 102, reflector 130, and lens rim 107 are not shown, the light source 125 has been simplified to a point source, and only a portion of the light rays are shown. FIG. 4 shows lens 106 with the first broad surface 122 facing the light source 125 and the second broad surface 120 facing away from the light source 125. An axis 140 is shown passing through the center of the lens 106. The pattern of optical features on the first broad surface 122 causes a substantial portion of the light rays emitted from the light source 125 to diverge. In the example shown in FIG. 4, the diverging light rays 144 constitute a majority of the light rays and the converging light rays 142 a minority of the light rays, thereby producing a relatively wide light distribution.

In contrast, FIG. 5 shows lens 106 after being reoriented or flipped over, as described above, so that the first broad surface 122 faces away from the light source 125 and the second broad surface 120 faces the light source 125. In the second orientation shown in FIG. 5, the light rays emitted from the light source 125 do not encounter the pattern of optical features on the first side 122 until after the light rays pass through the lens 106. As a result of this second orientation, there are more converging light rays 142 than diverging light rays 144 and the lens 106 provides a more narrow light distribution relative to the first orientation shown in FIG. 4.

The example dual distribution lens 106 illustrated in FIGS. 1-5 has a pattern of optical features on the first broad surface 122 and a smooth surface on the second broad surface 120. The pattern of optical features on the first broad surface 122 has features with the shape of a four-sided pyramid. However, to achieve other light distributions, the features can have other shapes including but not limited to conic, tetrahedral, or hexagonal. Additionally, in other example embodiments, instead of a smooth surface, the second broad surface 120 of the lens 106 can have a pattern of optical features that is different from the pattern of optical features on the first broad surface 122. The differing patterns of optical features on opposite sides of the lens can also be used to achieve different light distributions. While the pattern of optical features on the first broad surface 122 are shown extending from the lens 106, it should be understood that in other embodiments, other types of features affecting light distribution can be embedded within the lens proximal to one or both of the first side and the second side of the lens.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A luminaire comprising:

a housing;

a light emitting diode light source disposed within the housing;

a reflector disposed within the housing and oriented to reflect a portion of light from the light emitting diode light source; and a lens disposed within the housing, the lens comprising a first side and a second side, at least one of the first side and the second side comprising a pattern of optical features, wherein the lens comprises an attachment feature that attaches the lens to the reflector, wherein the attachment feature is configured to attach the lens to the luminaire in a first position with the first side facing the light emitting diode light source and in a second position with the second side facing the light emitting diode light source.

2. The luminaire of claim 1, wherein the attachment feature is disposed on a rim of the lens.

3. The luminaire of claim 2, wherein the attachment feature is disposed on an inner surface of the rim of the lens.

4. The luminaire of claim 2, wherein the attachment feature is disposed on an outer surface of the rim of the lens.

5. The luminaire of claim 1, wherein the attachment feature comprises a plurality of tabs.

6. The luminaire of claim 1, wherein the attachment feature comprises one of detents and threads.

7. The luminaire of claim 1, wherein the attachment feature comprises:

a first plurality of tabs proximate to a first edge of a rim of the lens, wherein when the lens is attached to the luminaire in the first position, the first plurality of tabs fit into corresponding recesses in the reflector; and a second plurality of tabs proximate to a second edge of the rim of the lens, wherein when the lens is attached to the luminaire in the second position, the second plurality of tabs fit into the corresponding recesses in the reflector.

8. The luminaire of claim 1, wherein the pattern of optical features is disposed on the first side of the lens and the second side of the lens is smooth.

9. The luminaire of claim 1, wherein when the lens is attached to the luminaire in the first position, the lens causes a majority of the light from the light emitting diode light source to diverge as it passes through the lens.

10. The luminaire of claim 1, wherein each optical feature of the pattern of optical features has a shape selected from the group consisting of pyramidal, conical, tetrahedral, and hexagonal.

11. The luminaire of claim 1, wherein the first side of the lens comprises a first pattern of optical features and the second side of the lens comprises a second pattern of optical features.

12. The luminaire of claim 1, further comprising an aperture through which the light from the light emitting diode light source exits the luminaire after passing through the lens.

13. The luminaire of claim 12, wherein the lens is disposed between the aperture and the light emitting diode light source.

14. A luminaire comprising:

a housing;

a light emitting diode light source disposed within the housing; and a lens disposed within the housing, the lens comprising a first side and a second side, at least one of the first side and the second side comprising a pattern of optical features, wherein the lens comprises an attachment feature configured to attach the lens to the luminaire in a first position with the first side facing the light emitting diode light source and in a second position with the second side facing the light emitting diode light source, wherein the attachment feature is disposed on an inner surface of a rim of the lens or an outer surface of the rim of the lens.

15. The luminaire of claim 14, wherein the attachment feature comprises:

a first plurality of tabs proximate to a first edge of the rim of the lens, wherein when the lens is attached to the luminaire in the first position, the first plurality of tabs attach to the luminaire; and a second plurality of tabs proximate to a second edge of the rim of the lens, wherein when the lens is attached to the luminaire in the second position, the second plurality of tabs attach to the luminaire.

16. The luminaire of claim 14, wherein the pattern of optical features is disposed on the first side of the lens and the second side of the lens is smooth.

17. The luminaire of claim 14, wherein when the lens is attached to the luminaire in the first position, the lens causes a majority of light from the light emitting diode light source to diverge as it passes through the lens.

18. A luminaire comprising:

a housing;

a light emitting diode light source disposed within the housing; and a lens disposed within the housing, the lens comprising a first side and a second side, at least one of the first side and the second side comprising a pattern of optical features, wherein the lens comprises an attachment feature configured to attach the lens to the luminaire in a first position with the first side facing the light emitting diode light source and in a second position with the second side facing the light emitting diode light source, wherein the attachment feature is one of: a plurality of tabs, a plurality of detents, or threads.

19. The luminaire of claim 18, wherein the pattern of optical features is disposed on the first side of the lens and the second side of the lens is smooth.

20. The luminaire of claim 18, wherein when the lens is attached to the luminaire in the first position, the lens causes a majority of light from the light emitting diode light source to diverge as it passes through the lens.

* * * * *